US005718494A

United States Patent [19]

Luddemann

[11] Patent Number: 5,718,494

[45] Date of Patent: Feb. 17, 1998

[54] CONVERTIBLE STORAGE SYSTEM

[75] Inventor: Klaus Luddemann, Whitby, Canada

[73] Assignee: G. D. Hanna Incorporated, Ontario, Canada

[21] Appl. No.: 690,046

[22] Filed: Jul. 31, 1996

[30] Foreign Application Priority Data

Jan. 16, 1996 [CA] Canada ..... 2167331

[51] Int. Cl.[6] ..... A47B 47/00

[52] U.S. Cl. ..... 312/258; 312/114; 312/6; 312/24.8

[58] Field of Search ..... 312/249.13, 249.8, 312/234, 240, 241, 258, 5, 114, 6, 297; 280/47.17, 47.18, 47.34; 52/7; 472/75, 81; 135/114, 88.1, 88.11; 190/1, 11, 12 R; 108/33, 41

[56] References Cited

U.S. PATENT DOCUMENTS

| | | | |
|---|---|---|---|
| D. 294,080 | 2/1988 | Golia et al. | D3/30.1 |
| D. 303,307 | 9/1989 | Juergens | D34/19 |
| D. 312,524 | 11/1990 | Juergens | D34/20 |
| D. 342,159 | 12/1993 | Daouk | D3/70 |
| D. 351,502 | 10/1994 | Weir et al. | D3/272 |
| 677,114 | 6/1901 | Buckingham | 190/11 |
| 1,476,389 | 12/1923 | Blank | 190/12 |
| 1,670,496 | 5/1928 | De La Fontaine | 190/12 |
| 4,082,388 | 4/1978 | Goeglein | 312/258 |
| 4,417,774 | 11/1983 | Bevan et al. | 312/108 |
| 4,519,318 | 5/1985 | Weldon-Ming | 108/33 |
| 5,108,122 | 4/1992 | Beagley | 280/475 |
| 5,186,330 | 2/1993 | McClure | 206/508 |
| 5,235,795 | 8/1993 | DeBusk | 53/467 |
| 5,356,027 | 10/1994 | Craft et al. | 220/338 |
| 5,480,225 | 1/1996 | Bailey | 312/258 |
| 5,486,043 | 1/1996 | Carr et al. | 312/249.8 |

FOREIGN PATENT DOCUMENTS

WO95/22269 8/1995 WIPO .

*Primary Examiner*—Peter M. Cuomo
*Assistant Examiner*—Gerard A. Anderson
*Attorney, Agent, or Firm*—D. Peter Hochberg; Mark Kusner

[57] ABSTRACT

A convertible system which is changeable from a portable storage mode to a display mode is formed by a first container, a second container and conversion material. The second container and the conversion material are held within the first container when the system is in the storage mode and the conversion material is removable from the first container and used to convert the system from the storage mode to the display mode.

20 Claims, 9 Drawing Sheets

CONVERTIBLE STORAGE SYSTEM

FIELD OF THE INVENTION

This invention relates to a convertible storage system and more particularly, a system which is convertible from a portable storage mode to a display mode.

BACKGROUND OF THE INVENTION

This invention relates to a storage case more particularly, a system which is convertible from a portable storage mode to a display mode.

A variety of display systems are commonly used at international exhibitions, trade shows, conventions, etc. for the display of products and services. Such display systems include portable wall systems including collapsible frameworks for constructing wall panel displays, table and counter top display areas and other display accessories. As most of these exhibitions are of a relatively short duration, primary considerations are given to cost and facility of erection and dismantling, portability, and multi-use applications.

One type of display system involves collapsible display structures suitable for covering with fabric or other graphic panels. The framework collapses and is able to be broken into one or more smaller bundles. The fabric or graphic panels are usually comprised of a carpet-like fabric removable from a frame and are rolled up. Additional accessories such as lights may also accompany display systems. The display systems including the collapsible framework, fabric rolls and other accessories are shipped to the exhibition destination and must be easily transported within the exhibition or convention hall to the final display location. To prevent damage to the rolls of fabric and particularly graphic panels, fabrics are sometimes shipped separately from the framework. Sometimes it is desirable to have more than one external cover or graphic panel for modification to the erected display. Collapsible displays have been shipped in special carrying cases.

Certain shipping regulations require that shipped articles do not exceed a specified size. Accordingly, it is desirable to provide a relatively lightweight carrying case for shipping and easily transporting a display system in which rolled fabric covers and framework bundles are able to be safely shipped together. Further it is desirable to facilitate the conversion of the portable storage case to a functioning element of the display system such as a counter display system.

It is desirable to permit easy maneuvering of the storage case through the convention or conference hall to the display area. Even though displays are relatively light in weight, a small person may still have difficulty moving the components of the display to a particular location. Accordingly, it is desirable to provide a storage container which is easily maneuvered.

SUMMARY OF THE INVENTION

The present invention provides a convertible system which is changeable from a portable storage mode to a display mode and meets all of the objectives listed above. More specifically, the convertible system of the present invention comprises a first container, a second container, and conversion material. The second container and the conversion material are held within the first container when the system is in the storage mode and at least the conversion material is removable from the first container to convert the system from the storage mode to the display mode.

The second container which preferably holds additional conversion material such as display panels and the like can also be made removable from the first container.

BRIEF DESCRIPTION OF THE DRAWINGS

The above as well as other advantages and features of the present invention will be described in greater detail according to the preferred embodiments of the present invention in which.

DETAILED DESCRIPTION OF THE PREFERRED EMBODIMENTS

Figure 1:
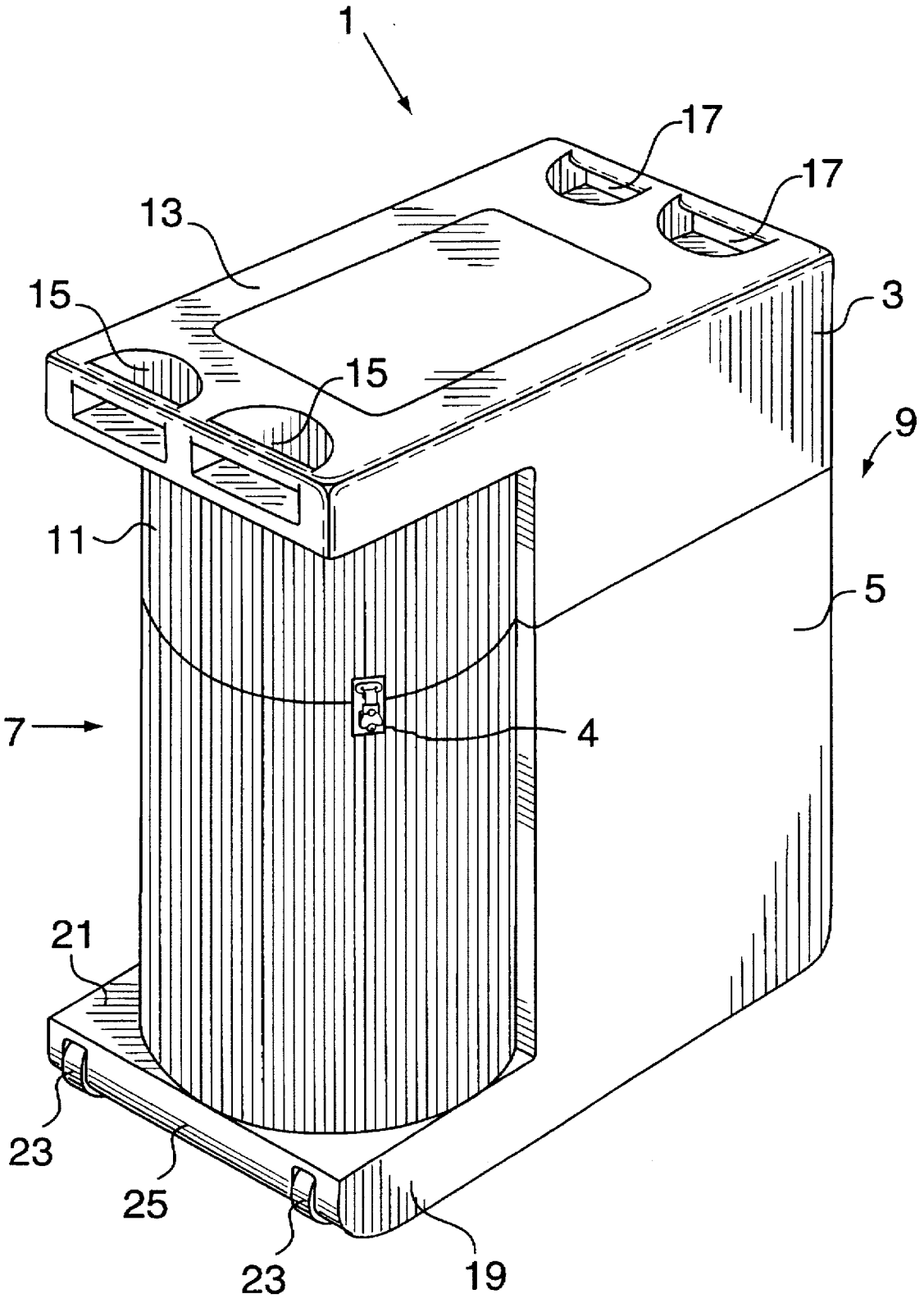
FIG. 1 is a perspective view looking down on a preferred embodiment of the convertible system when in the portable storage mode.

FIG. 1 shows the entire convertible system in its portable storage mode. The system comprises a first container generally indicated at 1 which is used to hold a second container 31 and conversion materials which will be described later in detail.

The first container 1 comprises an upper container section 3 and a lower container section 5. These two container sections are releasably secure to one another by means of lock mechanisms 4 spaced around the first container. Note that the upper container section 3 has a surrounding side wall which extends a relatively significant distance over the full height of the first container. Accordingly, when the upper container section is released from the lower container section, the upper container section can be used as a small stepping stool or the like.

Figure 5:
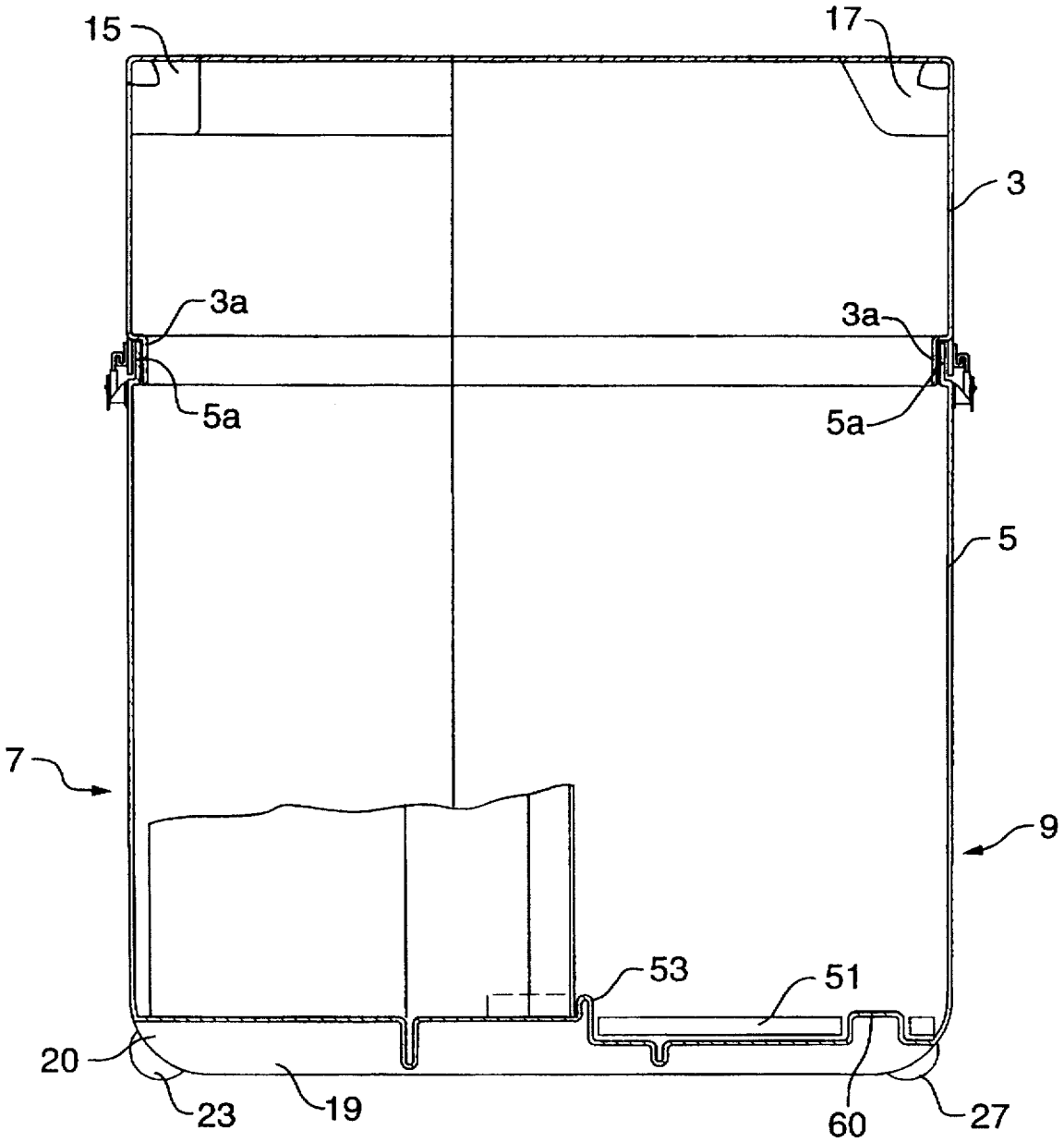
FIG. 5 is a partially sectioned view of the system in the FIG. 1 portable storage mode.

FIG. 5 of the drawings shows that the lower container section 5 has an upwardly extending single wall peripheral lip 5*a*. In this particular preferred embodiment, the upper container section has a double wall lower peripheral lip 3*a* which acts as a female coupler to fit over the single wall lip 5*a* of the lower container section. This double wall to single wall, male/female fitting blocks both inward and outward bowing of the upper lip or edge on the lower container section when the two container section are secured to one another.

The double wall construction of the lower lip of the upper container section also adds to its strength should the upper container section be used as a stepping stool.

The first container 1 has a first end 7 and a second end 9. The first end 7 as shown has a rounded configuration over much of its height. It is however covered from above by a rectangular top 13 of the first container. In addition, the first container has a rectangular base 19 so that it presents two foot steps 21 to either side of the rounded end 7 near the bottom of the first container.

The base of the first container is provided with a first set of wheels or rollers 23 at its first end 7 and a second set of wheels or rollers 27 also in the base at the second end 9 of the first container. Recessed handles 60 are positioned in the bottom wall of the first container, adjacent the side wall opposite the rounded wall, to assist in handling.

The two sets of wheels 23 and 27 allow the container to be rolled in an upright position, i.e. with both sets of rollers on the ground. In addition, the container can be tipped preferably towards its first end 7 such that the rollers 27 are lifted off of the ground and the container is rolled strictly on the rollers 23.

Figure 2:
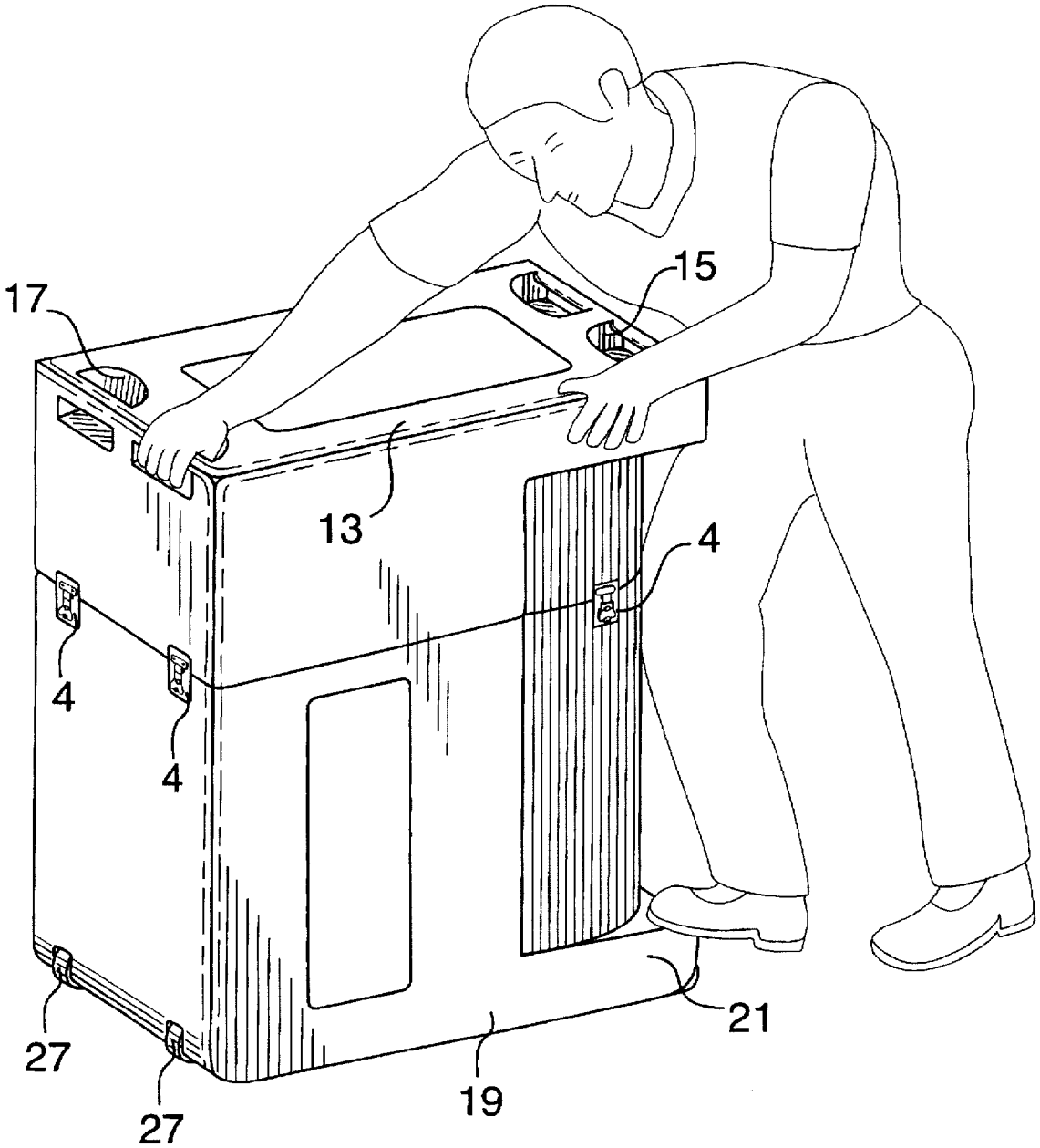
FIG. 2 is a further perspective view of the system in the portable storage mode with an operator in position to move the first container to a tipped position.

FIG. 2 of the drawings shows an operator in a position to tip the first container onto the rollers 23. This can be done in one of two ways. Firstly, the operator can place one of his or her feet on one of the foot steps 21 and reach across the top to hand openings 17 provided in the top 13 at the second end 9 of the container. This gripping position of the first container using the body weight of the operator pressing down on one of the steps 21 provides good leverage for tipping the first container onto the wheels 23. Here it should be noted that the base 19 of the container is curved as indicated at 20 in FIG. 5 so that there is no interference from the base of the container against its tipping onto the wheels 23.

The above described positioning of the operator, i.e. the position shown in FIG. 2 is one which is beneficial for a relatively small person who, in this particular position, still applies substantial leverage on the container to tip it. A larger stronger person can also tip the container by once again placing one of his or her feet on one of the foot rests 21 and then pulling on the top end of the container at a second set of hand grips or openings 15 at the top of the first end 7 of the container.

In addition, the system itself has features which add to the operator's ability to tip the container. Firstly, the second container 31 which is preferably used to store some of the conversion material is relatively heavy and because of its positioning at the first end of the first container adds to the operator's weight in tipping the first container. Furthermore, the rounding over much of the height of the first end of the first container allows the operator to have good knee clearance and leg positioning when the foot is placed on the foot step 21 with the operator bent over the container as shown in FIG. 2 to use substantially all of his or her body weight to tip the first container.

Figure 3:
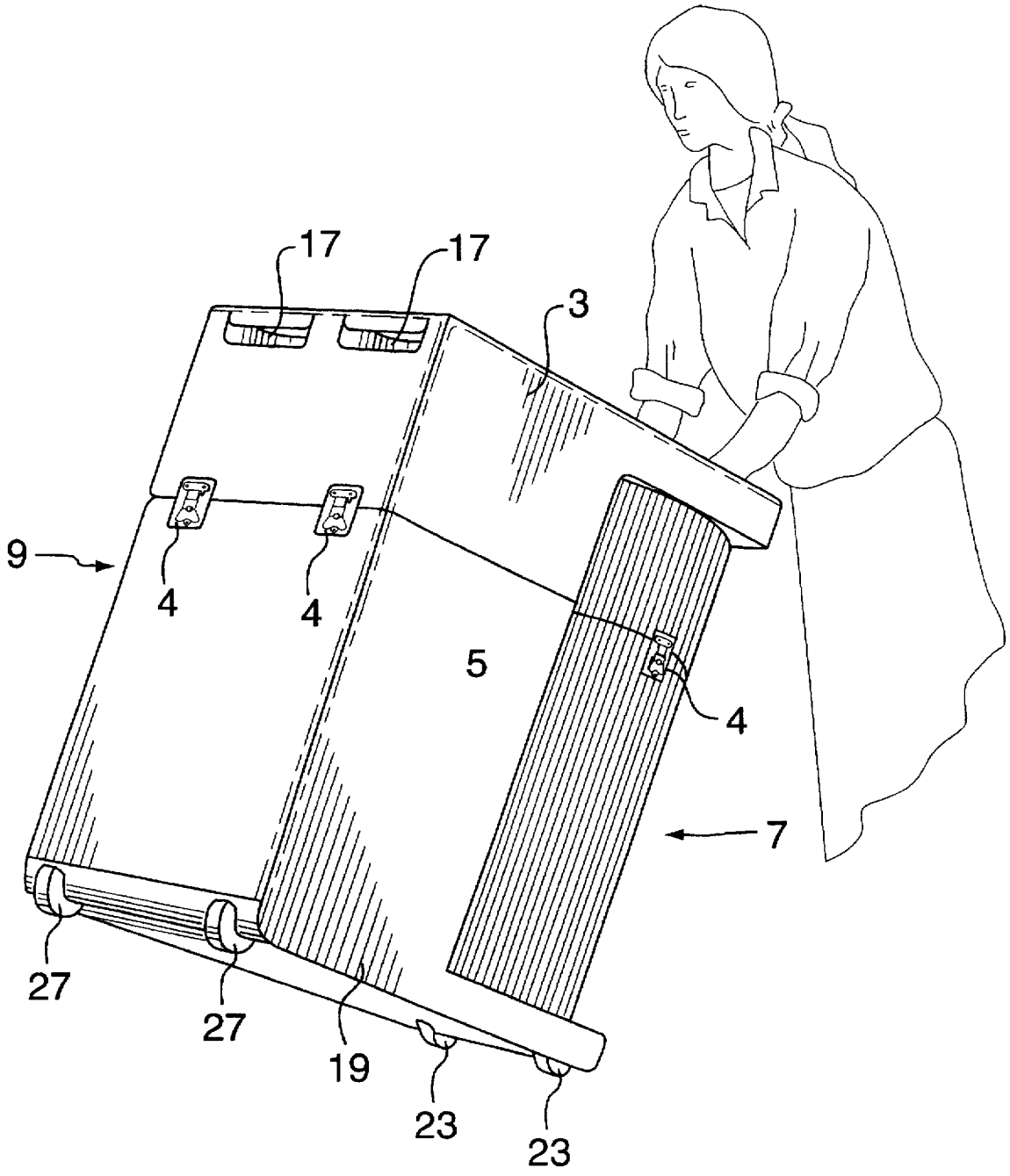
FIG. 3 shows the operator moving the first container in the tipped condition.

FIG. 3 of the drawings shows the operator rolling the container on the first set of wheels or rollers 23 in the tipped position. This is the preferable way of moving the first container because when it is tipped, the rollers can easily be moved over any small obstacles in its way. Furthermore, in this position, the first container is easily turned or otherwise maneuvered by the operator who as shown is in a fully erect, good visibility position while moving the first container around on rollers 23.

Figure 10:
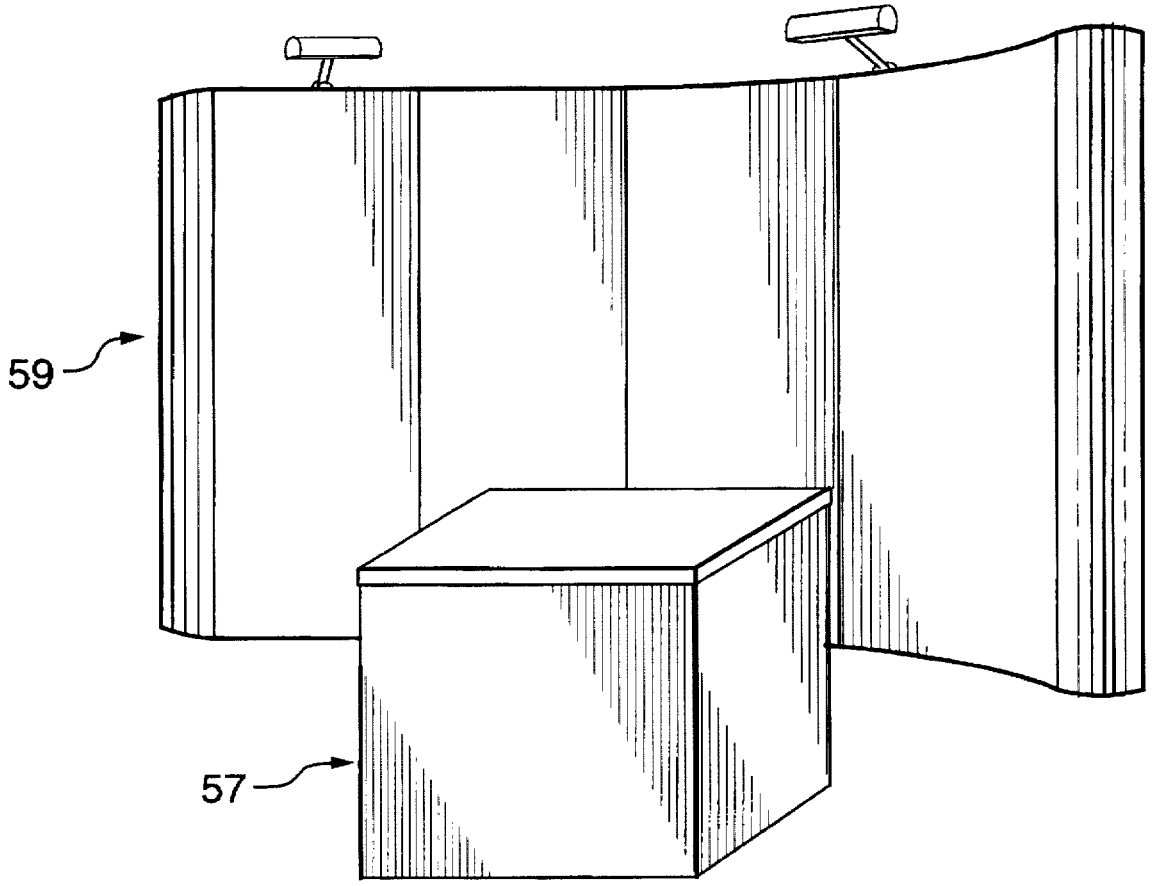
FIG. 10 shows the system with all of the conversion material set up so that the system has been completely changed to the display mode.

The system can be converted from the FIG. 1 storage mode described above to a full display mode as shown for example in FIG. 10 of the drawings. Furthermore, all of the conversion materials required to set up the display mode are carried internally of and protected by the first container 1. This container preferably has a durable plastic construction to easily withstand normal shipping conditions while protecting the conversion materials held within the first container. Furthermore, through the use of covers for the first container which form part of conversion materials, the first container itself ends up being a very important part of the display set up.

Here it should be noted that for shipping purposes, the overall dimensions of the first container are preferably kept at or below the maximum 130 inch girth size allowed by most shipping carriers.

Also it should be noted that the rounded end of the first container is provided with a series of vertical ribs as generally indicated at 11 in FIG. 1 of the drawings to substantially enhance the rigidity and strength of the first container for its intended shipping purpose.

Figure 4:
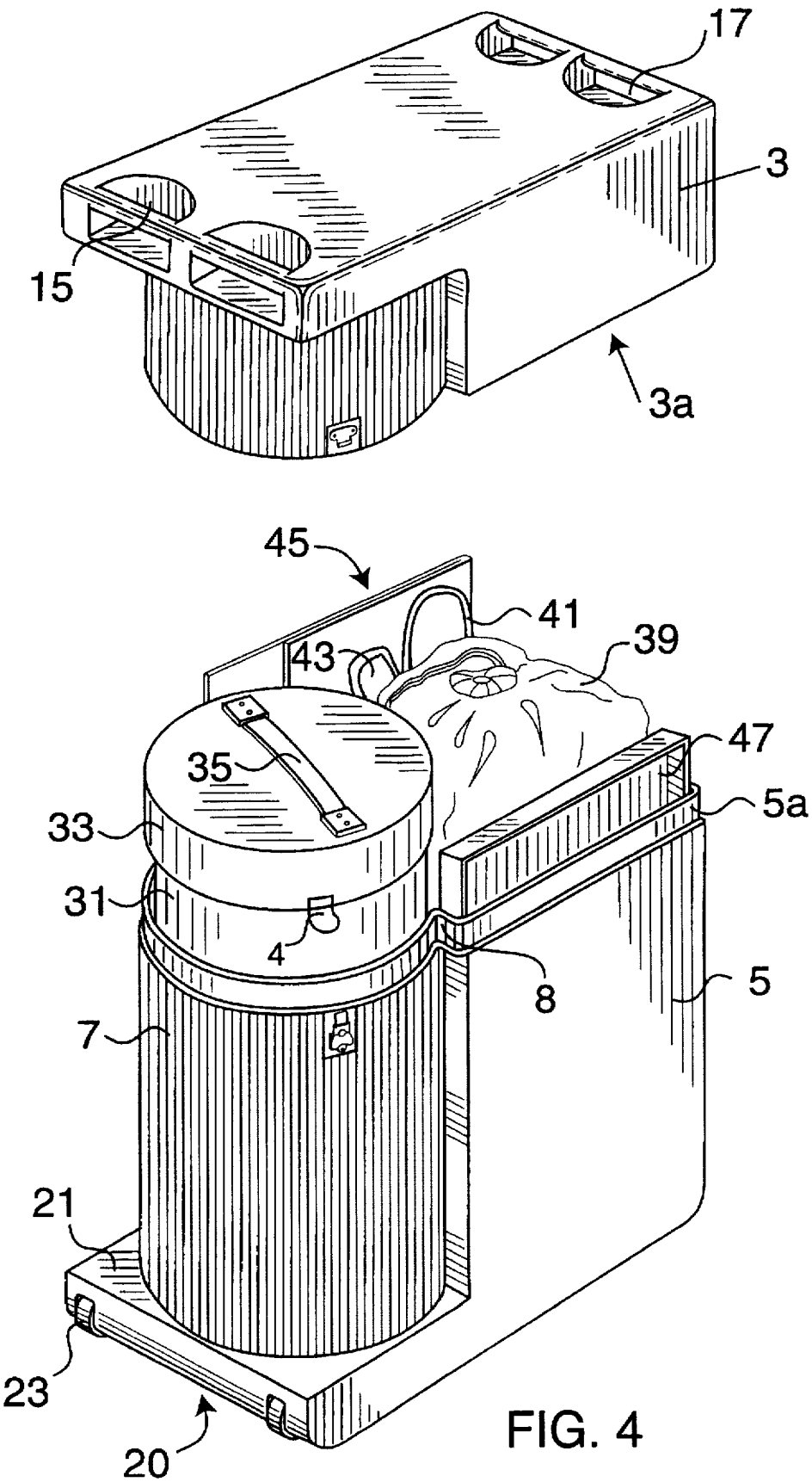
FIG. 4 is an exploded perspective view of the system of FIG. 1 showing separation of the container sections of the first container and the second container and conversion material contained within the first container.

FIG. 4 of the drawings shows the first container as it is being opened to gain access to the second container 31 as well as the additional conversion materials stored within the first container. In the preferred embodiment as shown, these additional conversion materials comprise frame forming bars contained within a frame bag 39, lights contained within a light bag 41, channel bars contained within a channel bag 33, conversion kit panels generally indicated at 45 and a conversion counter-top generally indicated at 47.

Figure 6:
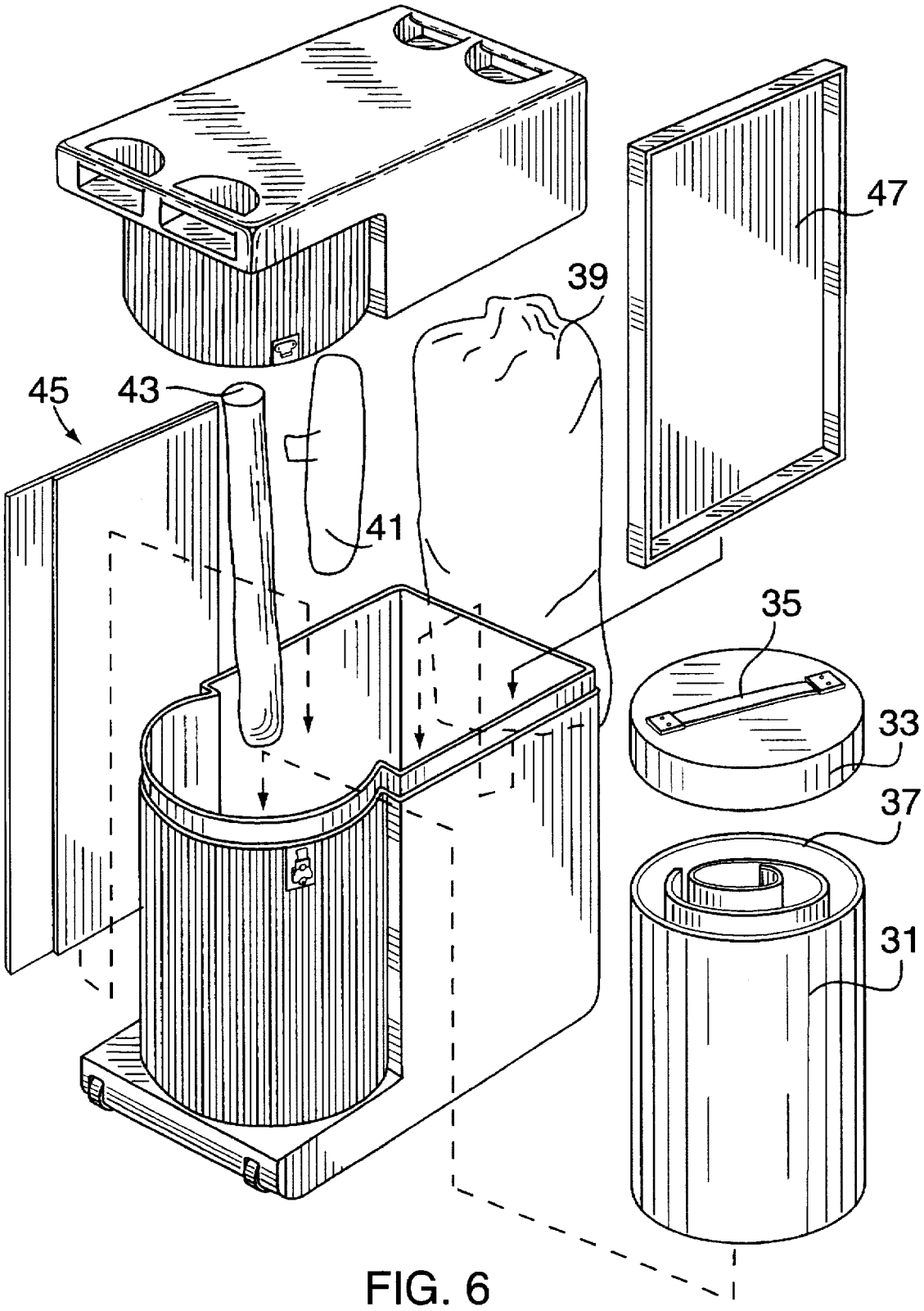
FIG. 6 is a further exploded perspective view showing the second container and conversion materials removed from the first container.

FIG. 6 shows that the second container 31 has a removable top 33 normally held to the main body of the container by locks 4 identical to those provided on the outside of the first container. However, when these locks are released, the top 33 is pulled off of the main body of the second container to expose rolled up panels 37 within the second container.

When the top of the second container is locked in position, the entire second container can be lifted from the first container by means of a handle 35 provided at its upper end.

Figure 7:
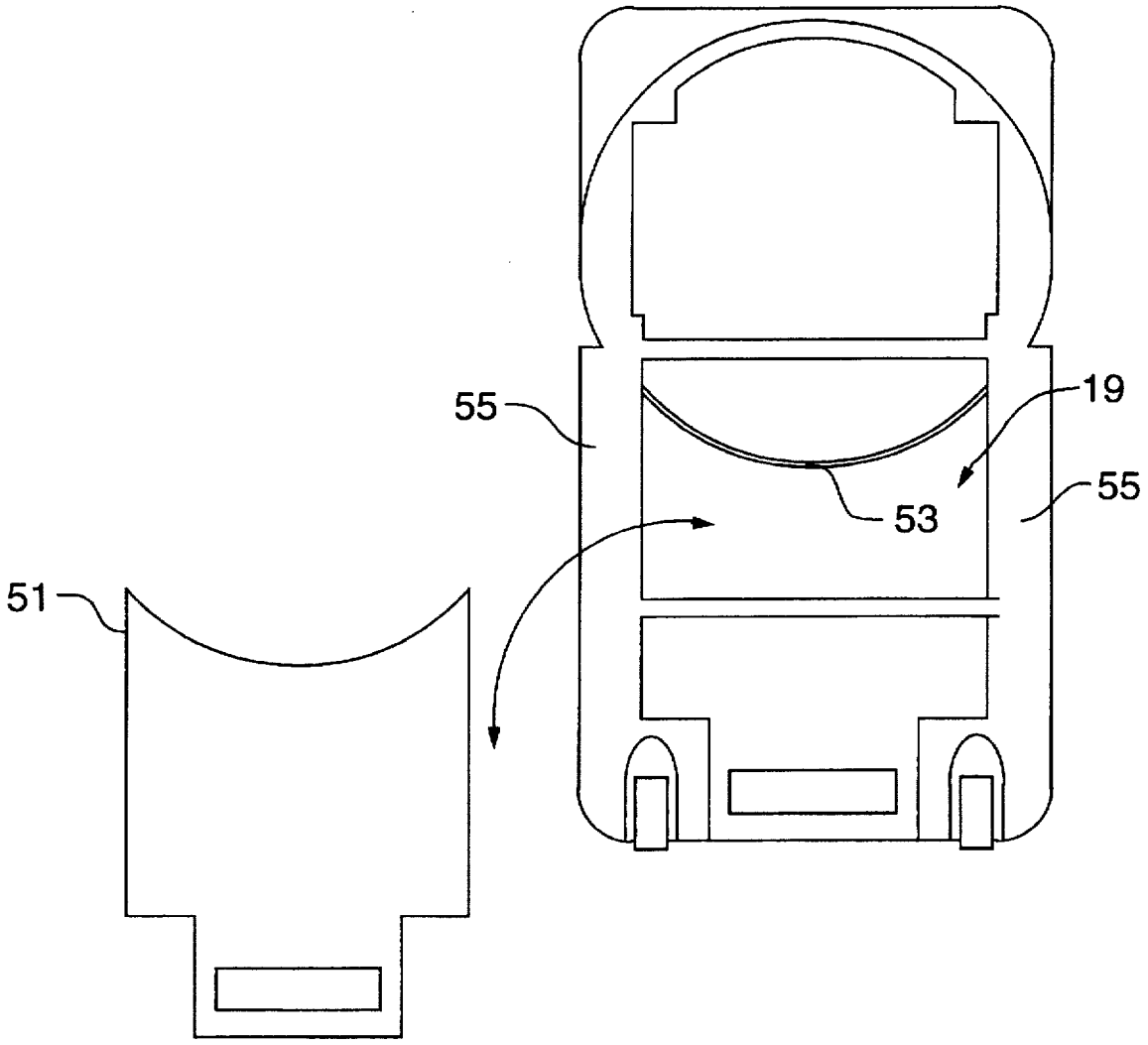
FIG. 7 is a top view looking down into the lower container section of the first container.

Reference now being had to FIGS. 5 and 7 of the drawings, it will be seen that the upper side of the base of the first container, i.e. to the inside of the first container is provided with a series or ridges and depressions which provide guides for fitting of both the bottom end of the second container and the additional conversion material. Furthermore, a conversion material directory is secured on the base to the inside of the first container to help locate the conversion materials. This directory which preferably does not have the same plastic construction as the rest of the first container is removably secured in place and is made from a material which allows printing directly on the directory so that it can be then positioned within the first container. Its shaping relative to the ridges and recesses on the base hold it in position within the first container.

More specifically, the first container base 19 is provided on its upper surface with a semi-circular ridge 53 against which the lower end of the second container is seated and trapped in position within the first container. It should also be noted as well shown for example in FIG. 4 of the drawings, that the rounded end 7 of the first container has a curvature greater than 180° so that it wraps around to a pair of lips 8, one on either side of the first container which are spaced from one another by a distance less than the full diameter of the second container. This in combination with the lip or ridge 53 at the first container base traps the second container from either sliding or tipping within the first container.

The upper side of the base 19 of the first container is additionally provided with recesses 55 to either side thereof. These recesses provide catches into which the lower ends of the conversion kit panels and the conversion kit counter top are lowered and held in position within the first container when in the storage mode.

One of the very substantial benefits provided by the second container is that the panel or panels 37 rolled up in the second container would without the trapping action of the second container unroll within the first container. This would make them extremely difficult to deal with and would further make it awkward to pack any of the further conversion material into the first container. However, the second container ensures that the panels remain rolled up so that they are much easier to handle both when they are stored within and removed from the first container.

Figure 8:
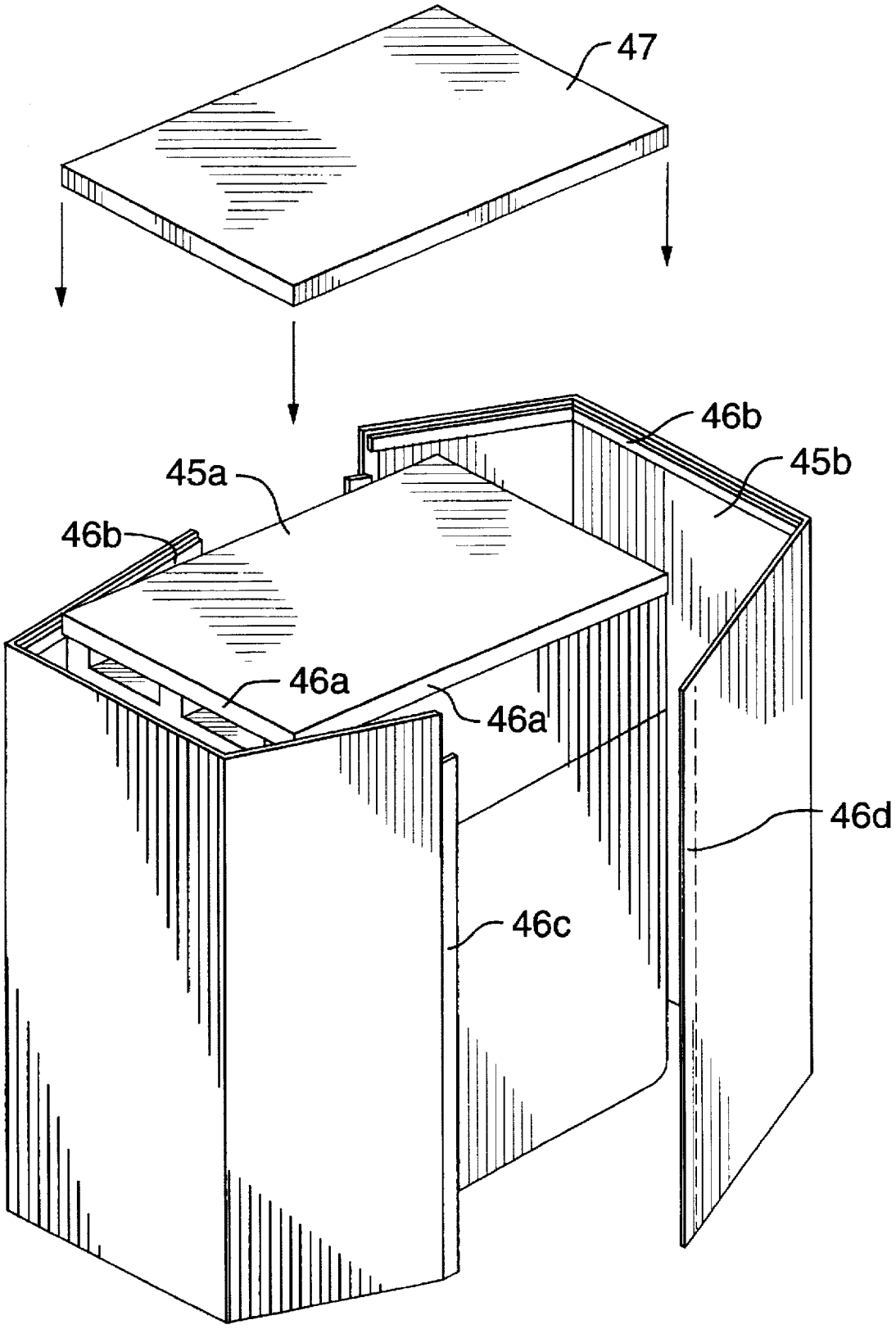
FIG. 8 is a perspective view showing the fitting of external covering from the conversion material over the first container.
Figure 9:
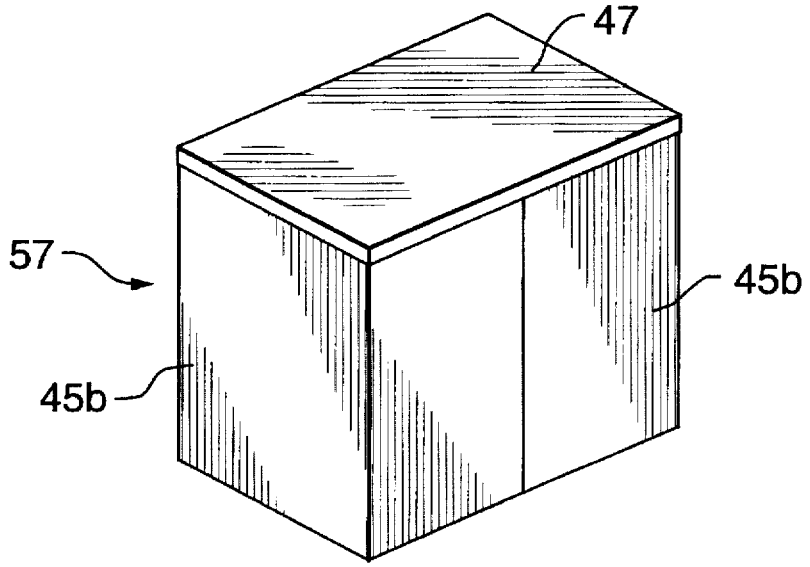
FIG. 9 shows the first container when completely covered with the external covering.

The changing or conversion of the system from the storage mode to the display mode is well shown in reference to FIGS. 8 through 10 of the drawings. In particular, FIG. 8 shows the conversion of the first container from a storage unit to a display table which is generally indicated at 57 in FIG. 9. This is achieved through the use of the conversion kit panels 45 and the conversion counter top 47.

The conversion kit panel 45 include a top panel **45*a* and side panels 45*b*. The top panel 45*a* sits directly on the top 13 of the first container. The top panel includes magnetic edges 46*a* which are folded down from their flat storage position to the position shown in FIG. 8 after the top panel has been placed on the first container. From here, the side panels 45*b* are wrapped around the sides of the first container and these panels include magnetic strips 46*b* which magnetically adhere to the folded down edges 46*a* of the top panel. In addition, the panels 45*b* include vertically extending magnetic strips 46*c* and 46*d*** that adhere to one another to secure the two side panels to one another.

The two side panels **45*b*** preferably have a fabric or carpet-like outer surface and when they are securely wrapped in position, give the side wall of the first container a very professional and complete appearance.

After the top panel and the side panels have been fitted into position, the conversion counter top 47, which has a rigid one piece construction, is then lowered so that its side edges or skirts fit to the outside of the side panels **45*b*** adding the final appearance and securing of the side panels to the display table.

An upright panel back drop generally indicated at 59 in FIG. 10, can then be added to the overall display through appropriate assembly of the frame and channel bars which are then covered by the panels removed from the second container. These panels once again have a preferably fabric or carpet-like appearance.

As a final touch, the lights from the light bag can be added to the display as also shown in FIG. 10 of the drawings.

When it is time to knock the display down, all of the display components or materials can easily be separated from one another and refitted in their stored positions within the first container which once again becomes a portable storage and shipping unit for the overall system.

Although various preferred embodiments of the invention have been described in detail, it will be appreciated by those skilled in the art that variations may be made without departing from the spirit of the invention or the scope of the appended claims.

The embodiments of the invention in which an exclusive property or privilege is claimed are defined as follows:

1. A convertible system which is changeable from a portable storage mode to a display mode, said system comprising a first container, a second container and conversion material, said second container and said conversion material being held within said first container when said system is in the storage mode and said conversion material being removable from said first container to convert said system from the storage mode to the display mode, wherein said conversion material includes flexible panels in a rolled up condition when in said first container and held within said second container, said second container having a cylindrical configuration for maintaining the rolled up condition of said flexible panels and containing them at a first end of said first container.

2. A system as claimed in claim 1, wherein said second container is removable from said first container.

3. A system as claimed in claim 1, wherein said conversion material comprises external covering material for converting said first container to a display table when said system is in the display mode.

4. A system as claimed in claim 3, wherein said conversion material further includes upright panel forming materials as a backdrop for said display table when said system is in the display mode.

5. A system as claimed in claim 4, wherein said conversion material further includes display lights.

6. A system as claimed in claim 1, wherein said first container comprises upper and lower container sections, one of said container sections having a single wall edge and the other container section having a double wall edge fittable over and blocking both inward and outward bowing of the single wall edge when the container sections are fitted to one another.

7. A system as claimed in claim 1, wherein said first end of said first container is rounded with a rectangular base beneath and extending outwardly of said first end to provide foot steps, one to either side of said first end of said container.

8. A system as claimed in claim 7, wherein said first end of said first container is provided with a first set of rollers beneath said base and said first container has a second end provided with hand grips at the top of said first container, said container being tippable onto said first set of rollers by standing on one of said foot steps and pulling upwardly on said hand grips.

9. A system as claimed in claim 8, wherein said first container has a second set of rollers beneath said second end of said first container for rolling without tipping of said first container.

10. A system as claimed in claim 7, wherein said first container has a rectangular top above said first end thereof.

11. A system as claimed in claim 1, wherein said conversion material includes external covering material for and converting said first container to a display table when said system is in the display mode, said external covering material comprising a top cover which fits over said rectangular top of said first container, said top cover having magnetic edges peripherally thereof and said external covering material further comprising wall covers for said first container which are magnetically secured to said magnetic edges of said top cover.

12. A system as claimed in claim 1, wherein said first container has a base with a top surface internally of said first container, said top surface of said base being provided with a raised ridge against the lower end of said second container and recesses for trapping some of said conversion material in specific regions of said base of said first container.

13. A system as claimed in claim 12 further including a conversion material directory removably secured on said base of said first container.

14. A convertible portable storage to display system comprising a first openable container, a second container and external covering for said first container, said second container and said external covering being contained within said first container when said system is used for storage purposes, and said second container and said external covering being removable from said first container with said external covering being shaped and sized to fit over and convert said first container to a table display when said system is used for display purposes, wherein said first container comprises upper and lower separable container sections, said first container having a sidewall, a lower part of which is defined by said lower container section and an upper part of which is defined by said upper container section, said upper container section having a top wall which defines a table top for said display table, said external covering comprising side covering for said sidewall and top covering for top wall of said first container, and wherein said sidewall comprises a first wall region formed by first and second spaced apart substantially flat wall members with a third substantially flat wall member connecting said first and second wall members at one end of said first container and second wall region found by a fourth rounded wall member connecting said first and second wall members at the other end of said first container, said second wall region having a mouth opening which is slightly smaller than the spacing between said first and second wall members and forming a receiving space for said second container.

15. A system as claimed in claim 14 wherein the counter top comprises recessed handle openings in the top surface communicating with recessed handle openings in the top region of opposing side walls.

16. A system as claimed in claim 14 wherein said second container contains additional display materials which are removable from said second container to be used as a back drop with said display table.

17. A system as claimed in claim 14 wherein said lower container section of said first container has a bottom wall which defines receiving spaces for said second container and said external coverings.

18. A system as claimed in claim 17 wherein said bottom wall comprises recessed handles means positioned externally adjacent the side wall opposite the said rounded wall.

19. A system as claimed in claim 14 wherein the height of said rounded wall is less than said flat walls and forming at least one raised step surface at the lower portion of the lower container section and a portion of the counter top at the upper portion of the upper container section.

20. A system as claimed in claim 14 wherein said round wall comprises vertically spaced apart rib-like stiffening protrusions around said end wall.

* * * * *